US008808596B2

(12) United States Patent
Hashimoto et al.

(10) Patent No.: US 8,808,596 B2
(45) Date of Patent: Aug. 19, 2014

(54) PROCESS OF MAKING POLYGLYCOLIC ACID RESIN FILAMENT

(75) Inventors: Satoshi Hashimoto, Ibaraki-Ken (JP); Kazuyuki Yamane, Fukushima-Ken (JP); Juichi Wakabayashi, Ibaraki-Ken (JP); Hirokazu Matsui, Ibaraki-Ken (JP)

(73) Assignee: Kureha Corporation, Tokyo (JP)

( * ) Notice: Subject to any disclaimer, the term of this patent is extended or adjusted under 35 U.S.C. 154(b) by 809 days.

(21) Appl. No.: 12/656,810

(22) Filed: Feb. 17, 2010

(65) Prior Publication Data

US 2010/0148391 A1 Jun. 17, 2010

Related U.S. Application Data

(62) Division of application No. 10/593,291, filed as application No. PCT/JP2005/004774 on Mar. 17, 2005, now abandoned.

(30) Foreign Application Priority Data

Mar. 18, 2004 (JP) ..... 2004/078854

(51) Int. Cl.

| | |
|---|---|
| ***D01F 6/62*** | (2006.01) |
| ***D02J 1/22*** | (2006.01) |
| ***D01D 5/088*** | (2006.01) |
| ***D01D 5/12*** | (2006.01) |
| ***D02G 3/44*** | (2006.01) |

(52) U.S. Cl.

CPC ..... *D01F 6/625* (2013.01); *D02J 1/223* (2013.01); *D02J 1/22* (2013.01); *D01D 5/0885* (2013.01); *D02J 1/228* (2013.01); *D01D 5/12* (2013.01); *D02G 3/444* (2013.01)

USPC ..... 264/210.7; 264/210.8; 264/211.14

(58) Field of Classification Search

USPC ..... 264/103, 178 F, 210.7, 210.8, 211.14

See application file for complete search history.

(56) References Cited

U.S. PATENT DOCUMENTS

| | | | | |
|---|---|---|---|---|
| 3,422,181 | A | | 1/1969 | Chirgwin |
| 5,041,529 | A | | 8/1991 | Shinoda et al. |
| 5,080,665 | A | | 1/1992 | Jarrett et al. |
| 5,324,307 | A | | 6/1994 | Jarrett et al. |
| 5,444,113 | A | | 8/1995 | Sinclair et al. |
| 5,456,696 | A | * | 10/1995 | Liu ..... 606/228 |
| 5,585,056 | A | * | 12/1996 | Liu ..... 264/103 |
| 5,695,879 | A | | 12/1997 | Goldmann et al. |
| 5,718,716 | A | | 2/1998 | Goddard et al. |
| 5,747,637 | A | | 5/1998 | Shinoda et al. |
| 6,011,121 | A | | 1/2000 | Goldmann et al. |
| 6,068,920 | A | | 5/2000 | Funae et al. |
| 6,090,908 | A | | 7/2000 | Jamiolkowski et al. |
| 6,090,910 | A | | 7/2000 | Shinoda et al. |
| 6,093,792 | A | | 7/2000 | Gross et al. |
| 6,150,497 | A | | 11/2000 | Sastry et al. |
| 2001/0016258 | A1 | | 8/2001 | Kimura et al. |
| 2002/0123546 | A1 | | 9/2002 | Bigg et al. |

FOREIGN PATENT DOCUMENTS

| | | |
|---|---|---|
| JP | 3-259029 | 11/1991 |
| JP | 4-108331 | 4/1992 |
| JP | 2000-265333 | 9/2000 |
| JP | 2003-27345 | 1/2003 |
| JP | 2003-40990 | 2/2003 |

OTHER PUBLICATIONS

International Search Report dated Jun. 28, 2005 in International (PCT) Application No. PCT/JP2005/004774 corresponding to the parent application of the present divisional application.

Supplementary European Search Report dated Sep. 26, 2008 in European Application No. EP 05 72 6650 corresponding to the present application.

* cited by examiner

*Primary Examiner* — Leo B Tentoni

(74) *Attorney, Agent, or Firm* — Wenderoth, Lind & Ponack, L.L.P.

(57) ABSTRACT

A biodegradable filament of polyglycolic acid resin having practical properties represented by high tensile strength and knot strength is produced. A polyglycolic acid resin having a residual monomer content of below 0.5 wt. % is melt-spun, quenched in a liquid bath of at most 10° C. and then stretched in a liquid bath of 60-83° C. to produce a polyglycolic acid resin filament having a tensile strength of at least 750 MPa and a knot strength of at least 600 MPa.

8 Claims, No Drawings

PROCESS OF MAKING POLYGLYCOLIC ACID RESIN FILAMENT

CROSS REFERENCE TO RELATED APPLICATIONS

This application is a Divisional application of Ser. No. 10/593,291, filed Sep. 18, 2006, now abandoned, which is a 371 application of PCT/JP2005/004774, filed Mar. 17, 2005.

TECHNICAL FIELD

The present invention relates to a polyglycolic acid resin filament having excellent mechanical properties, such as high tensile strength and knot strength, in combination with excellent biodegradability, and a process for production thereof.

BACKGROUND ART

Hitherto, as filament materials used for industrial materials, agricultural materials, fisheries materials, etc, particularly as fishing nets and fishing lines, there have been used synthetic resins, such as polyamide, polyester, polyolefin, polyvinylidene chloride and polyvinylidene fluoride, in view of mechanical properties required thereof. However, synthetic resin filaments composed of such synthetic resins are hardly decomposed in natural environments, so that if they are thrown away or left as they are, they remain semipermanently in the nature, thus posing a revere problem in environmental by genies. Particularly, there occur increasing troubles that discarded fishing nets and cut fishing lines are accumulated at the bottoms of the sea or lakes, and birds and creatures in water are entangled therewith to be killed or injured. Accordingly, an improvement in this respect is seriously desired from the viewpoints of environmental preservation and protection of the nature.

For this reason, in recent years, there have been frequently made development works regarding biodegradable filaments, for use as fisheries materials, such as fishing lines, fishing nets and fanning nets, or those used as agricultural materials and industrial materials that are biologically degraded after their actual use (Patent documents 1 and 2 below).

Further, biodegradable filaments are also used as polymer materials for medical use, such as biologically absorbable suture for physical surgery and artificial skins (Patent documents 3 and 4 below).

However, none of hitherto available biodegradable filaments have high mechanical strength and high biodegradability. Particularly, as for filaments for fishing lines, etc., knot strength is thought most of since they are frequently used in a knotted state, whereas no biodegradable filaments have satisfied a tensile strength of at least 750 MPa and a knot strength of at least 600 MPa which are minimum levels of high-strength filaments, such as those of polyamide, polyester and polyvinylidene fluoride, and a tensile elongation of 10-50% which is not too high or not too low in view of practical properties, such sensitivity, impact-absorptivity and handleability.

For satisfying these practical properties, biodegradable filaments having a core-sheath structure comprising a combination of different resins for the core and the sheath have been proposed (Patent documents 2 and 5 below), whereas none of them have satisfied the above-mentioned practical properties. For example, the composite filament of Patent document 2 has exhibited a tensile strength of ca. 739 MPa (6.6 g/denier) at the maximum and a knot strength of 615 MPa (5.5 g/denier) at the maximum, and the composite filament of Patent document 5 is described to exhibit a maximum tensile strength of 1000 MPa but also exhibited too large a tensile elongation of 70-250%.

Patent document 1: JP-B 2779972
Patent document 2: JP-A 10-102323
Patent document 3: U.S. Pat. No. 3,297,033
Patent document 4: JP-B 58-1942
Patent document 5: JP-B 3474482

DISCLOSURE OF INVENTION

Accordingly, the present invention aims at providing a biodegradable filament of polyglycolic acid resin satisfying practical properties represented by high tensile strength and knot strength in combination and a process for production thereof.

More specifically, according to a first aspect of the present invention, there is provided a polyglycolic acid resin filament comprising a polyglycolic acid resin having a residual monomer content of below 0.5 wt. % and exhibiting a tensile strength of at least 750 MPa and a knot strength of at least 600 MPa.

The present invention further provides a process for producing a polyglycolic acid resin filament, comprising: melt-spinning a polyglycolic acid resin having a residual monomer content of below 0.5 wt. %, quenching the spun resin in a liquid bath of at most 10° C. and stretching the spun resin in a liquid bath of 60-83° C.

As for a polyglycolic acid resin having excellent biodegradability, the production of filaments thereof was performed for providing surgical sutures (e.g., Patent documents 3 and 4 above). According to the present inventors' study, the production conditions including melt-spinning, air cooling and stretching at ca. 50-60° C., adopted therein are not necessarily proper for polyglycolic acid resin, and hitherto the polyglycolic acid resin as the starting material included a residual monomer (glycolide) content of 0.5 wt. % or more which has provided an obstacle to development of performance of the product filaments because the conditions for production of polyglycolic acid resin have not been clarified hitherto. In contrast thereto, the present inventors, etc., have succeeded in production of a polyglycolic acid resin having a low residual monomer content of below 0.5 wt. % through a combination of solid phase polymerization and treatment for removal of residual monomer (Japanese Patent Appln. 2004-078306), and by using the polyglycolic acid resin as a starting material and combining it with optimum melt spinning-stretching conditions, have succeeded in production of a biodegradable filament of polyglycolic acid resin.

BEST MODE FOR PRACTICING THE INVENTION

The polyglycolic acid resin filament of the present invention comprise a polyglycolic acid resin having a residual monomer content of below 0.5 wt. % and exhibiting a tensile strength of at least 750 MPa and a knot strength of at least 600 MPa. Hereinbelow, the polyglycolic acid resin filament of the present invention will be described in order along with the process of the present invention that is a preferred process for production thereof.

In the process for producing a polyglycolic acid resin filament according to the present invention, a polyglycolic acid resin having a residual monomer (glycolide) content of below 0.5 wt. % is used as a starting material. Herein, the polyglycolic acid resin (hereinafter sometimes referred to as "PGA resin") includes homopolymer of glycolic acid (including a ring-opening polymerization product of glycolide (GL) that is a bimolecular cyclic ester of glycolic acid) consisting only of glycolic acid recurring unit represented by a formula of: —(—O—$CH_2$—CO—)—, and also a glycolic acid copolymer containing at least 55 wt. % of the above-mentioned glycolic acid recurring unit.

Examples of comonomer providing polyglycolic acid copolymer together with a glycolic acid monomer, such as the above-mentioned glycolide, may include: cyclic monomers, such as ethylene oxalate (i.e., 1,4-dioxane-2,3-dione), lactides, lactones (e.g., β-propiolactone, β-butyrolactone, pivalolactone, γ-butyrolactone, γ-valerolactone, β-methyl-δ-valerolactone, and ϵ-caprolactone), carbonates (e.g., trimethylene carbonate), ethers (e.g., 1,3-dioxane), either esters (e.g., dioxanone), amides (ϵ-caprolactam); hydroxycarboxylic acids, such as lactic acid, 3-hydroxypropanoic acid, 3-hydroxybutanoic acid, 4-hydroxybutanoic acid and 6-hydroxycaproic acid, and alkyl esters thereof; substantially equi-molar mixtures of aliphatic diols, such as ethylene glycol and 1,4-butanediol, with aliphatic dicarboxylic acids, such as succinic acid and adipic acid, or alkyl esters thereof; and combinations of two or more species of the above.

The content of the above glycolic acid recurring unit in the PGA resin is at least 55 wt. %, preferably at least 70 wt. %, more preferably at least 90 wt. %. If the contact is too small, it becomes difficult to attain characteristic high mechanical properties of the PGA resin filament of the present invention. Within this extent, the PGA resin may comprise 2 or more species of polyglycolic acid (co)-polymers. Further, it is also possible to provide a filament having a structure of a core and a sheath respectively comprising two (or more) species of PGA resins or a PGA resin and another resin (preferably a homo- or co-polymer of the comonomer providing the glycolic acid copolymer together with glycolic acid) in a core: sheath weight ratio of, e.g., 5:95-95:5, more preferably 15:85-85:15.

As the polyglycolic acid resin, one having a residual monomer (glycolide) content of below 0.5 wt. %, preferably below 0.2 wt. %, is used. If the residual monomer content is 0.5 wt. % or more, the molecular weight of the resin is liable to be lowered at the time of melt-processing, particularly during the melt-processing, even if filaments are produced by the process of the present invention, so that the mechanical properties, such as tensile strength and knot strength, are liable to be fluctuated, and it becomes difficult to retain these desired properties while being displayed for sale in the stores. The above-mentioned residual content of below 0.5 wt. %, preferably 0.2 wt. %, should be satisfied by the entirety of the polyglycolic acid resin, and in the case of a copolymer or a resin mixture, should preferably be satisfied with respect to the polymerized glycolic acid units contained therein. The residual monomer content in the starting polyglycolic acid resin is transferred in substantially the same amount to the product filament through the filament production process of the present invention.

The reason by the physical properties are remarkably lowered if the residual monomer (glycolide) content is 0.5 wt. % or more, has not been fully clarified as yet. However, a first reason may be assumed that the residual monomer (glycolide) is rich in reactivity and functions as a self-catalyst under a high temperature condition in an extruder to cause transesterification of replacing long molecular chains with monomers or lower degree polymerizates, thus resulting in a lower molecular weight. A second reason may be assumed that glycolide (or glycolic acid) as the residual monomer functions as an acid catalyst for promoting the hydrolysis, particularly in the presence of water, thus particularly in a high temperature-high humidity environment.

The PGA resin used in the present invention may preferably be one having a high molecular weight as represented by a melt viscosity of preferably 50-6000 Pa·s, more preferably 100-5000 Pa·s, as measured at a temperature of 240° C. and a shear rate of 121 $sec^{-1}$, or a weight-average molecular weight of preferably at least 50,000, more preferably at least 80,000, particularly preferably 100,000 or higher. The upper limit of the weight-average molecular weight is on the order of 500,000, preferably 300,000.

Such a PGA resin suitably used in the present invention as described above may suitably be produced through a process described in the specification of the above-mentioned Japanese Patent Appln. 2004-078306 characterized by a combination of solid-phase polymerization and residual monomer removal treatment, and the description of the specification is intended to be incorporated herein by reference.

It is preferred that the PGA resin is melt-kneaded together with a thermal stabilizer, prior to the application of the filament production process of the present invention.

Suitable examples of the thermal stabilizer may include phosphoric acid esters having a pentaerythritol skeleton and/or alkyl esters of phosphoric acid or phosphonic acid (particularly $C_8$-$C_{24}$ alkyl esters of phosphoric acid or phosphonic acid having a basicity of at most 1.4), and the thermal stabilizer may be used in an amount of preferably at most 3 wt. parts, more preferably 0.003-1 wt. part, per 100 wt. parts of the PGA resin.

According to the process of the present invention, the PGA resin is melt-spun at an extrusion temperature of, e.g., 230-290° C., preferably 240-280° C. If the temperature is below 230° C., the extrusion of the resin becomes difficult due to an overload of the extruder screw motor. On the other hand, in excess of 290° C., the spinning becomes difficult due to thermal decomposition of the PGA resin.

Then, the thus-melt-spun PGA resin is quenched by introduction into a liquid bath of water, oil, etc., at a temperature of below 10° C. If the quenching temperature exceeds 10° C., the crystallization of PGA resin proceeds in a non-ignorable degree, and non-crystalline stretching thereafter is liable to be difficult, so that it become difficult to develop desired strength and mechanical properties.

Then, the PGA resin after the quenching is introduced into a liquid bath of an oil, such as silicone oil, polyethylene glycol or glycerin, alcohol or water, and is stretched in a temperature range of 60-83° C., preferably 70-80° C. The stretching may preferably be effected while the PGA resin is substantially in a non-crystalline state, and performed at a high stretch ratio of at least 3 times, particularly 4-8 times. If the stretching temperature is below 60° C., a desired high ratio of stretching becomes difficult due to a lower degree of softening of the resin. On the other hand, at a temperature in excess of 83° C., the crystallization of the PGA resin becomes non-ignorable so that a high-ratio stretching becomes difficult. Further, if such a high-ratio stretching is forcibly performed, orientation defects are liable to develop from crystal nuclei thus formed, so that it becomes difficult to obtain a filament of desired properties. Further, in the case of using an air bath, it is believed possible to effect similar non-crystalline stretching if an air bath temperature is set so as to provide a similar resin temperature as given by the above-mentioned liquid bath of 60-83° C.

If a second step (or further a third step) stretching is performed successively or after once cooled so as to provide an overall stretch ratio of 4.5 times or higher, particularly 5-10 times, further higher strengths can be expected. The second step stretching ratio is preferably at most 1.8 times, more preferably 1.5 times or below. The second step stretching temperature is preferably lower than the first step stretching temperature, but it is preferred that the difference therebetween is at most ca. 40° C., more preferably not larger than ca. 12° C., in view of the resultant knot strength. Thereafter, a relaxation treatment in a range of ca. 0.99-0.8 times may be performed, as desired.

The thus-obtained PGA resin filament of the present invention is characterized by a tensile strength of at least 750 MPa, preferably 800 MPa or higher, and a knot strength of at least 600 MPa, preferably 650 MPa or higher. Further; as an additional feature preferred in view of sensitivity, impact-absorptivity and handleability for fishing lines or surgical sutures, the PGA resin filament of the present invention may have a tensile elongation at breakage of 10-50%, more preferably 15-40%, particularly preferably 20-40%. A tensile elongation at breakage of higher than 20% and below 30% is further preferred. Further, the PGA resin filament of the present invention can provide a high tensile modulus of at least 12 GPa which is similar to or even higher than that of an aromatic polyester (PET) filament known as a high-rigidity filament. An extremely high knot strength of at least 600 MPa regardless of such a high rigidity can be attained only through a combination of certain degrees of surface softness and surface elongation, and is an extremely characteristic property of the PGA resin filament of the present invention not attainable by the conventional filament materials. The filament of the present invention is applicable to not only monofilaments but also multi-filaments.

The diameter of the PGA resin filament according to the present invention is not particularly limited but may preferably be in the range of 30 μm-3 mm, further preferably 50 μm-2 mm when used as a monofilament. On the other hand, in the case of a multi-filament, the diameter of each component filament may preferably be in the range of 0.1 μm-30 μm, further preferably 0.5 μm-20 μm.

The PGA resin filament of the present invention may be composed of a single layer, or plural layers, of which both the sheath layer (sheath material) and the core layer (core material) may comprise a PGA resin, or only the sheath larger (sheath material) may comprise a PGA resin, or further only the core layer (core material) may comprise a PGA resin. Preferably, in the case where the filament is composed of plural layers, it is suitable that the entire filament is composed of degradable resin(s). The proportion of the PGA resin in such a filament may preferably be at least 50 wt. %, further preferably and suitably 60 wt. % or more. It is further suitable that in either case where the filament is composed of a single layer or plural layers, the entirety is composed of PGA resin(s). Further, from the viewpoint of knot strength for fishing lines, for example, it is possible to incorporate a plasticizer within the sheath layer (sheath material) and/or the core layer (core material), or to increase the molecular weight of the sheath layer (sheath material) or the core layer (core material).

In the case of forming a composite filament, the resin combined with the PGA resin may suitably comprise degradable resins, inclusive of: aliphatic polyesters as represented by copolymers of glycolide with monomers of other degradable polymers, polylactic acid and polycaprolactone; polyalkylene succinates as represented polybutylene succinate; poly(β-hydroxyalkanoates) as represented by poly-3-hydroxybutyrate; and aliphatic polyester carbonate.

EXAMPLES

Hereinbelow, the present invention will be described more specifically based on Examples and Comparative Examples. Analysis methods and evaluation methods are as follows.

(1) Residual Monomer Content

Ca. 300 mg of a sample was dissolved in ca. 6 mg of DMSO (dimethyl sulfoxide) under heating at 150° C. for ca. 10 min., then cooled to room temperature and subjected to filtration. To the filtrate, certain amounts of chlorobenzophenone and acetone were added as internal standards. Then, 2 μl of the solution was sampled and injected into a GC apparatus for determination of the content of residual monomer (glycolide).

〈GC Analysis Conditions〉

Apparatus: Shimadzu GC-210

Column: TC-17 (0.25 mm-dia.×30 m)

Column temperature: Held at 150° C. for 5 min., then elevated to 270° C. at a rate of 20° C./min. and held at 270° C. for 3 min.

Evaporation chamber temperature: 200° C.

Detector: FID (hydrogen flame ionization detector)

Temperature: 300° C.

(2) Melt Viscosity

A polymer sample was contacted with dry air at 120° C. to reduce its moisture content to 50 ppm or less. The melt viscosity measurement was performed by using "Capillograph IC" (made by K.K. Toyo Seiki) equipped with a capillary of 1 mm-dia.×10 mm-L. Ca. 20 g of the sample was introduced into the apparatus heated at a set temperature of 240° C., held for 5 min. and then subjected to measurement of melt viscosity at a shear rate of 121 $sec^{-1}$.

Molecular Weight Measurement

In order to dissolve a polymer sample in a solvent used for molecular weight measurement, an amorphous state of the polymer was obtained. More specifically, ca. 5 g of a sufficiently dried polymer was sandwiched between aluminum plates, placed on a heat press at 275° C. for 90 sec. of heating, then held for 1 min. under a pressure of 2 MPa, and immediately thereafter transferred to a water-circulating press machine to be cooled. Thus, a transparent amorphous pressed sheet was prepared.

Ca. 10 mg of a sample cut out from the above-prepared pressed sheet, and the sample was dissolved in 10 mg of hexafluoroisopropanol (HFIP) containing 5 mM of sodium trifluoroacetate dissolved therein. The sample solution was filtrated through a membrane filter made of polytetrafluoroethylene and then injected into a gel permeation chromatography (GPC) apparatus for measurement of molecular weight. Incidentally, the sample was injected into the GPC apparatus within 30 min. after the preparation thereof.

〈GPC Measurement Conditions〉

Apparatus: "Shodex-104", made by Showa Denko K.K.

Column: two columns of "HFIP-606M" connected in series, and a pre-column.

Column temperature: 40° C.

Elution liquid: 5 mM-sodium trifluoroacetate solution in HFIP,

Flow rate: 0.6 ml/min.

Detector: RI (refractive index) detector.

Molecular weight calibration was performed by using 5 species of standard polymethyl methacrylate having different molecular weights.

Filaments obtained in Examples and Comparative Examples below were subjected to evaluation of the following properties.

(4) Tensile Strength, Knot Strength, Tensile Elongation (Tensile Elongation at Break), Knot Elongation (Knot Elongation at Break) and Tensile Modulus of Elasticity.

Tensile strength, tensile elongation and tensile modulus of elasticity were respectively measured according to JIS L1013 by using a tensile tester ("TENSILON Model UTM-III-100", made by Orientec K.K.) in a chamber of 23° C. and 65% R.H. under the conditions of a test length of 300 mm, a tensile speed of 300 mm/min. and a measurement number n=5. Knot strength and elongation were measured under the same tensile conditions after forming a knot at a middle point between sample chucks to determine a strength and an elongation at the time of breakage.

Degradability in Sea Water.

A sample filament was sandwiched between metal meshes and placed in a metal-made cage, and the cage was sunk in sea water in front of an embankment in Onahama harbor and pulled up several times with time to measure residual strength and elongation.

Comparative Example 1

A commercially available polycaprolactone-based biodegradable resin ("CELLGREEN P-H7", made by Daicel Kagaku Kogyo K.K.) as a starting material was melt-spun through a 35 mm-dia. extruder and a single-layered nozzle with 6 holes of each 2 mm in diameter at an extruder temperature of 150° C. and a nozzle temperature of 140° C., introduced into a water bath of 20° C. for quenching and taken up at a rate of 10 m/min. to form an unstretched filament, which was successively stretched at 5.0 times in warm water to obtain a monofilament of 0.31 mm in diameter.

Comparative Example 2

Polyglycolic acid (PGA) (made by Kureha Kagaku Kogyo K.K.; residual monomer=0.8 wt. %, melt-viscosity=2560 Pa·s) was melt-spun through a 35 mm-dia. extruder and a single=layered nozzle with 6 holes of each 1.3 mm in diameter at an extruder temperature of 250° C. and a nozzle temperature of 230° C., introduced into a water bath of 20° C. for quenching after an air gap of 10 cm and taken up at a rate of 8.4 m/min. to form an unstretched filament. The unstretched filament was crystallized and opaque. The unstretched filament was fed at a rate of 2 m/min. and introduced into a glycerin both at 80° C., to effect a stretching at 5.2 times, thereby obtaining a monofilament of 0.3 mm in diameter.

Example 1

PGA (made by Kureha Kagaku Kogyo K.K.; residual monomer=0.18 wt. %, melt-viscosity=2786 Pa·s) was similarly melt-spun through the same extruder and nozzle as in Comparative Example 2 at an extruder temperature of 260° C. and a nozzle temperature of 230° C., introduced into a water bath of 5° C. after an air gap of 6.5 cm for quenching, and taken up at a rate of 4.5 m/min., followed by introduction into a glycerin bath at 80° C. to effect a stretching at 6.0 times, thereby obtaining a monofilament of 0.26 mm in diameter.

Example 2

A monofilament of 0.26 mm in diameter was obtained through spinning by using the same material and the same conditions as in Example 1, followed by stretching at 6.25 times in a glycerin bath at 80° C.

Comparative Example 3

A monofilament of 0.26 mm in diameter was obtained under the same conditions as in Example 1 except that the temperature of the glycerin bath for stretching was raised to 85° C. The thus-obtained monofilament was opaque as a whole and exhibited a low tensile strength, so that the measurement of knot strength and knot elongation was not performed.

Physical properties of the monofilament obtained in the above Examples and Comparative Examples are inclusively shown in Table 1 below.

TABLE 1

| Example | Tensile strength (MPa) | Tensile elongation (%) | Knot strength (MPa) | Knot elongation (%) | Tensile modulus of elasticity (GPa) |
|---|---|---|---|---|---|
| Comp. 1 | 281 | 147 | 224 | 115 | 0.8 |
| Comp. 2 | 471 | 15 | 392 | 10 | 10 |
| Comp. 3 | 483 | 92 | — | — | — |
| 1 | 800 | 37 | 650 | 32 | 15 |
| 2 | 1030 | 29 | 700 | 20 | 17 |

Example 3

The monofilament obtained in Example 2 was subjected to the test of Degradability in sea water, whereby the residual strength was reduced completely to zero after the lapse of 6 months.

Comparative Example 4

A commercially available biodegradable fishing line (of polybutylene succinate adipate ("FIELD MATE", made by Toray K.K.; 8 lb., diameter=0.31 mm) was subjected to the test of Degradability in sea water similarly as in Example 3. The results are inclusively shown in Table 2 below.

TABLE 2

| Elapsed | Example 3 | | | | Comparative Example 4 | | | |
|---|---|---|---|---|---|---|---|---|
| | Tensile strength | | Tensile elongation | | Tensile strength | | Tensile elongation | |
| period (months) | Strength (MPa) | Retention rate (%) | Elongation (%) | Retention rate (%) | Strength (MPa) | Retention rate (%) | Elongation (%) | Retention rate (%) |
| 0 | 1030 | 100 | 29 | 100 | 270 | 100 | 38.7 | 100 |
| 3 | 261 | 25 | 8 | 28 | 258 | 95 | 36.7 | 95 |
| 6 | 0 | 0 | 0 | 0 | 204 | 76 | 30.8 | 79 |

It is understood that the product of the present invention (Example 3) is superior to the commercially available product (Comparative Example 4) in respects of initial strength and degradability.

Example 4

PGA (made by Kureha Kagaku Kogyo K.K.; residual monomer=0.37 wt. %, melt-viscosity=3049 Pa·s) was melt-spun through the same extruder and nozzle as in Comparative Example 2 at an extruder temperature of 275° C. and a nozzle temperature of 265° C., introduced into a water bath of 6° C. after an air gap of 15 cm for quenching, and taken up at a rate of 5 m/min., followed by introduction into a glycerin bath at 80° C. to effect a stretching at 6.0 times, thereby obtaining a monofilament of 0.24 mm in diameter.

Example 5

The monofilament obtained in Example 4 was further introduced into a glycerin bath at 90° C. to effect a second stretching at 1.15 times (giving a total stretching ratio of 6.9 times), thereby obtaining a monofilament of 0.21 mm in diameter.

TABLE 3

| Example | Tensile strength (MPa) | Tensile elongation (%) | Knot strength (MPa) | Knot elongation (%) | Tensile modulus of elasticity (GPa) |
|---|---|---|---|---|---|
| 4 | 1190 | 34 | 930 | 28 | 16 |
| 5 | 1294 | 18 | 1071 | 14 | 21 |

The monofilament obtained in Example 4 was left standing at room temperature (23° C., 60% RH), and the tensile strength and elongation were measured again. As a result, as shown in Table 4 below, substantially no changes were observed after the lapse of 70 days, and the strength and elongation were retained at more than 90% even after the lapse of 90 days.

TABLE 4

| Elapsed | Tensile strength | | Tensile elongation | |
|---|---|---|---|---|
| period (days) | Strength (MPa) | Retention rate (%) | Elongation (%) | Retention rate (%) |
| 0 | 1190 | 100 | 34 | 100 |
| 70 | 1170 | 98 | 34 | 100 |
| 90 | 1100 | 92 | 33 | 97 |

Thus, it is understood that the product of the present invention can exhibit biodegradability (in sea water), while retaining the physical properties in a certain period of non-contact with water, e.g., a period of display on a shop front, by suppressing the residual monomer content.

INDUSTRIAL APPLICABILITY

As described above, according to the present invention, there is provided a polyglycolic acid resin filament having practical properties represented by high tensile strength and knot strength. Taking advantage of its excellent strength and biodegradability, the thus-obtained polyglycolic acid resin filament can be suitably used as various industrial materials inclusive of fisheries materials, such as fishing nets and fishing lines, and agricultural materials, or sutures and binding filaments for surgery.

The invention claimed is:

1. A process for producing a polyglycolic acid resin filament free of plasticizer, comprising:

melt-spinning a polyglycolic acid resin comprising glycolic acid homopolymer and having a residual monomer content of below 0.5 wt. %, quenching the spun resin in a liquid bath of at most 10° C., and stretching the spun resin at a ratio of 4-8 times in a liquid bath of 60-83° C., thereby producing a polyglycolic acid resin filament free of plasticizer having a tensile strength of at least 750 MPa and a knot strength of at least 600 MPa.

2. A process for producing a filament according to claim 1, wherein a second-step stretching is performed after said stretching in a second liquid bath at a temperature higher than the temperature of said stretching and at a stretching ratio of at most 1.8 times.

3. A process for producing a filament according to claim 2, wherein the second-step stretching is performed after said stretching at a temperature which is higher than the temperature of said stretching by at most ca. 40° C.

4. A process for producing a filament according to claim 2, wherein the second-step stretching is performed after said stretching at a temperature which is higher than the temperature of said stretching by at most ca. 12° C.

5. A process for producing a polyglycolic acid resin filament free of plasticizer, comprising:

melt-spinning a polyglycolic acid resin, quenching the spun resin in a liquid bath of at most 10° C., then subjecting the spun resin to a first-step stretching at a ratio of 4-8 times in a liquid bath at a temperature of 60-83° C., and then subjecting the spun resin to a second-step stretching in a liquid bath at a temperature higher than the temperature of the first-step stretching by at most 12° C. and at a stretching ratio of at most 1.8 times, thereby producing a polyglycolic acid resin filament free of plasticizer having a tensile strength of at least 750 MPa and a knot strength of at least 600 MPa.

6. A process for producing a filament according to claim 1, wherein a polyglycolic acid resin having a residual monomer content of below 0.2 wt. % is subjected to the melt-spinning.

7. A process for producing a filament according to claim 5, wherein a polyglycolic acid resin having a residual monomer content of below 0.2 wt. % is subjected to the melt-spinning.

8. A process for producing a polyglycolic acid resin filament, comprising:

melt-spinning a polyglycolic acid resin comprising glycolic acid homopolymer and having a residual monomer content of below 0.5 wt. %, quenching the spun resin in a liquid bath of at most 6° C., and stretching the spun resin at a ratio of 4-8 times in a liquid bath of 60-83° C., thereby producing a polyglycolic acid resin filament having a tensile strength of at least 750 MPa and a knot strength of at least 600 MPa.

* * * * *